United States Patent [19]

Pennisi

[11] Patent Number: 4,717,158

[45] Date of Patent: Jan. 5, 1988

[54] GAME FOOTBAG

[76] Inventor: Anthony J. Pennisi, 50 Barber, San Anselmo, Calif. 94960

[21] Appl. No.: 878,937

[22] Filed: Jun. 26, 1986

[51] Int. Cl.[4] ..... A63B 37/02; A63B 37/12

[52] U.S. Cl. ..... 273/58 A; 273/415; 273/DIG. 24; 428/69

[58] Field of Search ..... 273/415, DIG. 24, 58 A, 273/58 F, 58 H, 58 R, 199 R, 199 A; 428/69

[56] References Cited

U.S. PATENT DOCUMENTS 4,011,611 3/1977 Lederman ..... 273/415 X 4,015,111 3/1977 Spector ..... 273/DIG. 24

4,151,994 5/1979 Stalberger ..... 273/415 X 4,479,649 10/1984 Newcomb et al. ..... 273/DIG. 24

*Primary Examiner*—George J. Marlo

*Attorney, Agent, or Firm*—Townsend and Townsend

[57] ABSTRACT

An improved game footbag which is durable and inelastic. The footbag is made of a sphere of soft light emitting plastic material which has a plurality of air holes in its surface. The sphere is filled with a fluid, light emitting particulate pellet filler material. The air holes enable air to escape upon compression, thereby giving the footbag inelasticity. The footbag may also include an opening of sufficient diameter to receive a light stick. At the same time, the plastic material is strong, giving the bag durability since woven seams, required in leather footbags, are not required.

6 Claims, 4 Drawing Figures

GAME FOOTBAG

BACKGROUND

This invention relates to game footbags designed to be kicked repeatedly into the air.

The desirable characteristics of a footbag are that it not bounce when kicked and not bounce or roll when dropped. Many, if not all users, of footbags have experienced frustration at footbags whose kicking surface was inconsistent, construction failed at the seams, and had limited use to only well-lighted and relatively dry areas.

Heretofore, a wide variety of footbags have been proposed and implemented for use in the sport. The footbag in U.S. Pat. No. 4,151,994, issued to Stalberger May 1, 1977, utilizes sewn leather construction.

Another type of footbag is the KICKER, manufactured by Wham-O Corporation, San Gabriel, Calif. The KICKER utilizes the same construction design as Stalberger's, but fluorescent-colored vinyl panels are substituted for leather.

Still another type of footbag is the JAMMER of Wham-O Corporation, San Gabriel, Calif. The JAMMER is constructed from eight joined leather panels rather than two. An additional type of footbag is the SIPA. The SIPA is constructed by knitting a material such as nylon into a sphere.

Other pertinent prior art that is not categorized specifically as footbags include:

U.S. Pat. No. 2,644,890, issued to Hollihan Apr. 7, 1949, which describes an amusement device (specifically FIG. 3) that is spherical and has phosphorescent material adhered to the inner wall of the sphere. The wall or envelope of this design consists of two hemispherical segments separated by an ornamental band.

U.S. Pat. No. 3,734,498, issued to Seiersen May 22, 1973, shows a soft ball with internal drag for inhibiting rolling.

Most users therefore would find it desirable to have a footbag that is of more sound construction, has a symmetrical and therefore consistent kicking surface, is unharmed by water and is, in fact, washable, useable in darkened and no-light situations, and can be functionally and decoratively enhanced with respect to color, graphics or symbols.

SUMMARY OF THE INVENTION

The present invention is an improved game footbag which is durable and inelastic. The footbag is made of a sphere of soft plastic material which has a plurality of air holes in its surface. The sphere is filled with a fluid, particulate pellet filer material. The air holes enable air to escape upon compression, thereby giving the footbag inelasticity. At the same time, the plastic material is strong, giving the bag durability since woven seams, required in leather footbags, are not required.

In an alternate embodiment, the soft plastic sphere does not have air holes and is instead vacuum sealed. Thus, the absence of air on the inside makes the footbag inelastic.

A valve can be included in the footbag, having a diameter of approximately one-eighth inch, into which a light stick can be inserted so that the footbag can be seen in the dark. Alternately, the particulate fill matter or the sphere itself could be made of a light-emitting material. The use of a soft plastic mold to make the footbag, rather than the leather used in prior art footbags, enables designs to be molded onto the exterior of a footbag and also enables different colors to be put on the exterior of the footbag, as desired.

Accordingly, the objects and advantages of the invention are: to provide a footbag that has a consistent kicking surface; to provide a footbag that is not harmed by water and is, in fact, washable; to provide a footbag that can be adapted for use in low-light situations by the insertion of a disposable light stick such as those produced by American Cyanamide Corporation, Wayne, N.J., U.S. Pat. No. 3,597,362; to provide a footbag that has an infinite range with respect to color; to provide a footbag that can employ a variety of fills for appearance and/or performance; to provide a footbag that can be raised and/or indented markings permanent to the surface that enhance the footbag in both appearance and function (function here refers to the increased traction and handling properties inherent in an unsmooth surface). Further objects and advantages of the invention will become apparent from a consideration of the drawings and ensuing description.

DETAILED DESCRIPTION OF THE PREFERRED EMBODIMENTS

Figure 1:
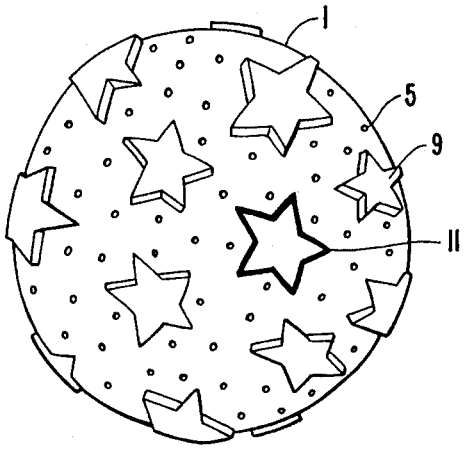
FIG. 1 is a perspective view of a preferred embodiment of the invention.

FIG. 1 shows a preferred embodiment of an improved footbag according to the present invention. A sphere 1 made from a soft plastic material includes a plurality of air holes 5. The footbag can also have raised designs 9 or indented designs 11.

Figure 2:
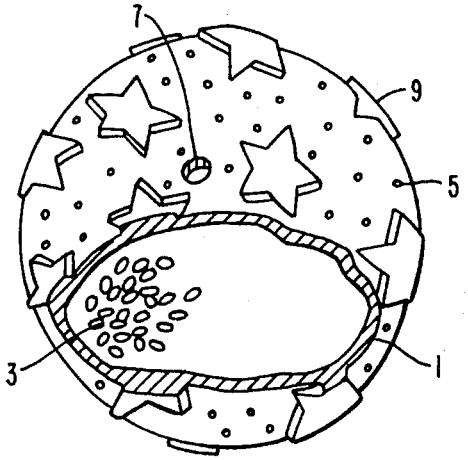
FIG. 2 is a partially broken-away view of the embodiment of FIG. 1.
Figure 3:
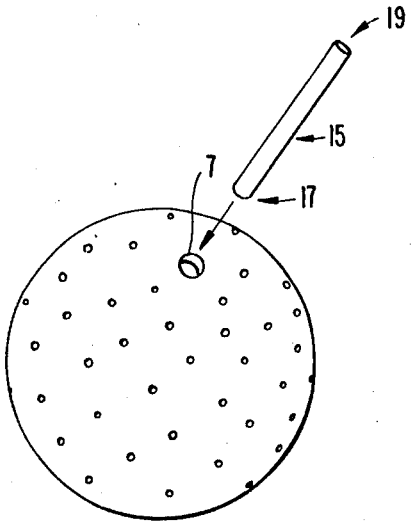
FIG. 3 is a perspective view of a second preferred embodiment of the invention with a light stick.

As shown in the cutaway view of FIG. 2, the interior of the footbag is filled with a large number of pellets 3. Pellets 3 have a diameter which is larger than that of air holes 5, thus preventing the escape of the pellets through the air holes. A valve 7 is provided through which the pellets can be inserted into the sphere. Valve 7 preferably has a diameter of approximately one-eighth inch to allow the insertion of a light stick as shown in FIG. 3. Alternatively, a closed valve can be used so that a light stick is not required.

FIG. 3 shows a commercially available light stick 15 having ends 17 and 19 for insertion into valve 7. Light stick 15 serves to close valve opening 7 as well as provide a light-emitting source so that the footbag can be seen in the dark.

Figure 4:
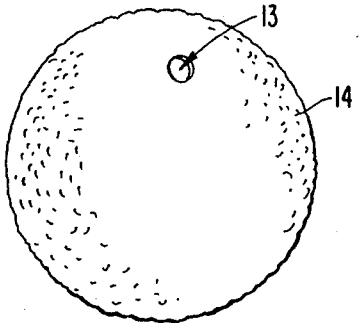
FIG. 4 is a perspective view of a third preferred embodiment of the invention.

FIG. 4 shows an alternate embodiment of the footbag according to the present invention, including a vacuum seal valve 13. Sphere 14 is made of a soft plastic material without any air holes so that the sphere can be vacuum sealed. The vacuum seal gives the sphere its inelastic quality.

The footbag of the present invention is made by molding a hollow sphere with a thin wall from extremely soft and pliable plastic. The sphere is then filled with a particle fill to +70% capacity. Numerous air holes smaller than the fill are either created during molding, drilled, or punched. The combination of soft plastic, thin wall, particle fill, and air holes to equalize the internal/external air pressure create a footbag with a consistent kicking surface that inhibits both rolling and bouncing. During the molding process, a rubber or plastic valve is commonly used to deliver the liquid plastic to the mold. If the valve used has an opening equal to or slightly smaller than the diameter of the light stick to be used with the invention, a pressure fit valve is created that will hold the light stick inside the sphere during use and allows for easy removal when the light stick is to be discarded. The mold of the footbag can be engraved with raised and/or indented graphics. Small fluctuations in the surface of the sphere (i.e., 1/1000 of an inch) create improved traction.

There are two ways to manufacture a molded footbag. One is to fill the sphere to capacity with particle fill and then vacuum-seal. The second, the preferred embodiment of the invention, is to partially or completely fill the sphere, equipped with air holes, with the particle mass. The air holes are designed to equalize the internal and external air pressure.

There are at least two types of manufacturing methods well suited to the invention: blow molding and rotational molding. Rotational molding will yield the better product and is the method discussed herein.

A pliable plastic such a polyvinyl chloride with a durometer range of 5–40, with 25 considered ideal, is injected into the cavities of the mold via a rubber or plastic valve that has an opening of ⅛ of an inch. (This is 1/16 less than the diameter of the light stick used in the case of Lunker Lights, U.S. Pat. Nos. 3,597,362 and 3,539,794 by American Cyanamid Corporation, Wayne, N.J. 07470. The cylinder is 1 and ½ inches by 3/16.)

The valve's function is threefold: First, it allows the cavity of the mold to be injected with the material to be molded; second, it is used to fill the molded sphere with the desired amount of particle filler material after the mold is cooled; and third, it is used as a pressure fit valve to hold a light stick in place during use and allows for easy insertion and removal of the light stick. Referring to FIG. 2, valve 7 is inserted in the mold cavity and an amount of plastic is inserted through valve 7 so that sphere 1 is approximately 30/1000±15/1000 of an inch thick for a 2 inch sphere (a 15/1000 per inch minimum diameter is preferred). During molding, raised graphics 9 or indented graphics 11 (See FIG. 1) will be formed if the mold cavity has been engraved. The formation of the air valves 5 can also be formed during molding or they can be punched or drilled after molding. Once the sphere has been formed and cooled, a particle fill, such as plastic pellets, are injected into sphere 1 through valve 7. The fill 3 should occupy not less than 70% of sphere 1 and be of a size greater than air valves 5 and less than the opening of valve 7. It is preferred that the material for the sphere be clear and that the material for the fill be dyed with rechargeable fluorescence.

The footbag of the present invention can be used as any other footbag; maintained in the air by kicking with the feet. Referring to FIG. 3, valve opening 7 for the holding of light stick 15 (i.e. Lunker Lights, U.S. Pat. Nos. 3,597,363 and 3,539,794, American Cyanamid Corporation, One Cyanamid Plaza, Wayne, N.J. 07470) should be in place during use to prevent loss of fill 3 and as convenient storage for light stick 15. When light conditions do not facilitate use because it is too dark to see effectively, light stick 15 should be activated by removing it from the footbag via valve 7 (assuming an operable one has been stored here). Light stick 15 can be removed by locating it inside the footbag and then exerting finger pressure on end 17 to push end 19 through valve 7. When end 17 has extruded as far as possible, removal is completed by gripping sphere 1 and end 19 and pulling apart. Light stick 7 is then activated by bending and shaking it until it is glowing uniformly. Light stick 15 is then inserted into sphere 1 through valve 7 until end 19 is flush with the surface of sphere 1. The invention is now ready for hours of use in lighting conditions ranging from low-light to complete darkness. The invention can also be used in dark situation if a rechargeable fluorescent dye is used to color fill 3 and/or sphere 1. In this case exposing the invention to light will activate the fluorescence and allow the invention to be used in the dark. It is preferred that sphere 1 remain clear and fill 3 treated with fluorescent dye. This is because both fluorescent dyes and light sticks come in a variety of colors and when used in tandem, the contrasting colors will have a striking visual affect, and the two light-emitting sources provide a backup for each other giving the user greater versatility.

When the footbag is used in darkened conditions, the users will not be able to see their feet. The resulting increased concentration on the footbag will heighten the foot-eye coordination of the users and increase their spatial awareness. This aspect of the invention is of particular interest to those involved with improvement in coordinative, cognitive and perceptual recognition and development.

Thus, the reader will see that the footbag of the invention provides a highly versatile, reliable device that can be used in almost every situation. While the above description contains many specifics, these should not be construed as limitations on the scope of the invention, but rather as an exemplification of one preferred embodiment thereof. Many other variations are possible. For example, a multitude of valves that hold light sticks can be on one sphere for increased visibility. A variety of materials or their combinations can be used as the filler for variations on performance and appearance. Color or fluorescent dye can be added to the sphere or fill and the air valves can vary in number and in placement for function and/or appearance. Accordingly, the scope of the invention should be determined not by the embodiment illustrated, but by the appended claims and their legal equivalents.

What is claimed is:

1. An improved game footbag, comprising:

a hollow sphere molded from a soft plastic compound formed by polymerization and defining a plurality of air holes located uniformly throughout the surface of said sphere permitting the passage of air from the interior to the exterior of said sphere, said soft plastic compound having sufficient rigidity to maintain the shape of said sphere except under compression; and fluid, particulate pellets of filler material disposed within said sphere, said pellets having a diameter greater than a diameter of said air holes.

2. The footbag of claim 1 wherein said sphere includes a valve of sufficient diameter to accept a light stick and greater in diameter than the diameter of said pellets.

3. The footbag of claim 2 wherein said valve has a diameter of approximately ⅛ inch.

4. The footbag of claim 1 wherein said pellets are made from a light-emitting material.

5. The footbag of claim 1 wherein said sphere is made from a light-emitting material.

6. An improved game footbag comprising:

a hollow sphere molded from a soft plastic compound formed by polymerization and defining a plurality of air holes uniformly located throughout the surface of said sphere, said sphere also including a valve having a diameter sufficient to accept a light stick, said soft plastic compound having sufficient rigidity to maintain the shape of said sphere except under compression; and fluid, particulate pellets of filler material disposed within said sphere, said pellets having a diameter greater than a diameter of said air holes.

* * * * *